US007357664B2

(12) United States Patent
Hsu

(10) Patent No.: US 7,357,664 B2
(45) Date of Patent: Apr. 15, 2008

(54) HIGH DEFINITION DIGITAL INTERFACE AND THE ASSEMBLY PROCESS THEREOF

(76) Inventor: Chingjen Hsu, No. 239, YuanShanBei Ave, Yuanshan Association District, Changping town, Dongguan (CN) 523583

( * ) Notice: Subject to any disclaimer, the term of this patent is extended or adjusted under 35 U.S.C. 154(b) by 0 days.

(21) Appl. No.: 11/609,584

(22) Filed: Dec. 12, 2006

(65) Prior Publication Data

US 2007/0134983 A1 Jun. 14, 2007

(30) Foreign Application Priority Data

Dec. 13, 2005 (CN) ..... 2005 1 0102343

(51) Int. Cl.
*H01R 12/24* (2006.01)

(52) U.S. Cl. ..... 439/499; 439/942

(58) Field of Classification Search ..... 439/499, 439/492, 493, 497, 874, 942, 494
See application file for complete search history.

(56) References Cited

U.S. PATENT DOCUMENTS 4,074,929 A * 2/1978 Krider ..... 439/398
6,139,372 A * 10/2000 Yang ..... 439/701
6,726,503 B2 * 4/2004 Waddell et al. ..... 439/465
6,802,744 B2 * 10/2004 Chiang ..... 439/701
2004/0185708 A1 * 9/2004 Kuwahara ..... 439/497

* cited by examiner

*Primary Examiner*—Phuong Dinh
(74) *Attorney, Agent, or Firm*—Banger Shia

(57) ABSTRACT

The present invention discloses a high definition digital interface and the assembly process thereof. The interface comprises: a terminal; a plastic middle member; a plastic wire-threading member; and a plastic wire-guiding member, wherein the plastic members are fastened to each other, a plurality of guide slots to accommodate the core wires and the terminal wiring ends is furnished on the plastic middle member, a plurality of wire slots to accommodate the core wires is furnished on the plastic wire-guiding and wire-threading members respectively. In accordance with the assembly process of the present invention, the core wires are firstly embedded into the wire slots of the plastic wire-guiding and wire-threading members, then the plastic members are assembled and the C-shaped hold clips are applied to fix the core wires, and then the core wires and the terminal wiring ends are inserted into the fixture of the automatic welder for welding by structure for heating with light stream.

6 Claims, 3 Drawing Sheets

HIGH DEFINITION DIGITAL INTERFACE AND THE ASSEMBLY PROCESS THEREOF

CROSS-REFERENCE TO RELATED APPLICATIONS

This application claims priority to Chinese Patent Application No. 200510102343.X filed Dec. 13, 2005, the contents of which are incorporated herein by reference.

BACKGROUND OF THE INVENTION

1. Field of the Invention

This invention relates to digital interfaces, and more specifically, to a high definition digital interface and the process for assembling thereof.

2. Description of the Related Art

The multimedia interfaces such as HDMI 1.3, Micro usb, Dvi, Displayport, udi, and so on, are all belong to high frequency interfaces. The HDMI 1.3c can provide a data transmission speed of up to 10.2 Gbps, the Micro usb and the Dvi can provide a speed up to 5.1 Gbps and 4.95 Gpbs, respectively, while the udi can offer a much faster speed of up to 21 Gpbs. Nowadays, the HDMI 1.3 is used as the connecting wire of a portable device to a TV and can transmit non-compressive audio signal and high resolution video signal, in the meantime, the transformation between the digital/analog or analog/digital signals is not needed before the transmission so that a high quality transmission of audio-visual signal can be realized. To the consumers, the HDMI technology can not only provide a high definition picture quality, but also simplifies the installation of home theatre systems since both the audio and video signals can be transmitted by a same cable. The Micro usb is used as the signal wire for connecting a portable device or a camera to a TV, Dvi is used in PC (personal computer), and Displayport is used in the relevant fields of PC/TV. Currently, the digital interfaces of HDMI 1.3, Micro usb, Dvi, Displayport, udi, and so on, do not have a structure to support the core wires, the arrangement of core wires is in such a terrible mess that the signal interference between the core wires are often occurred and thus the transmission performance is influenced largely. Moreover, the core wires are manually welded to the connector so that the work efficiency is low and the welding quality is poor. In current technologies, the following steps are included to assembly the core wires: peeling away the outermost sheath outside the core wire; stripping the dense netted wire away; removing the outer and inner aluminum foils; stripping the sheath of the core wire away by stripping pliers; and finally, welding the core wires piece by piece to the interface. All these steps are carried out manually, and only one core wire can be handled every time in the steps of stripping the sheath of the core wire and welding. For example, there are 19 connecting wires for the digital TV, the operation of stripping the sheath of the core wire and welding has to be repeated 15 times (except the 4 ground wires without sheath) and 19 times, respectively. Therefore, the work efficiency is low, the quality is unstable, the size of the weld spot is inconsistent to each other as shown in FIG. 1, and the welding of terminal ends close to each other can not be carried out easily, which is likely to cause the connector short-circuited and thus the rubber core scalded, unstable transmission performance of the connector, as well as low percentage of good products.

SUMMARY OF THE INVENTION

In view of the above-described problems, it is an objective of the present invention to provide a high definition digital interface and its assembly process, said digital interface includes a plastic wire-guiding member and a plastic wire-threading member to support the core wires and further a plastic middle member by which an automatic welding process can be realized, and offers the advantages of simple configuration, welding time and labor saving, and improved welding performance.

To achieve the above objective, the high definition digital interface in accordance with the present invention comprises a terminal, a metallic front shell, a plastic front member, a plastic middle member, and a plastic wire-threading member, wherein the plastic front member is positioned inside the metallic front shell, said plastic middle member is fastened to the plastic front member, a plurality of guide slots is furnished on the two facial surfaces of the plastic middle member for housing the wiring ends of the terminal therein; said plastic wire-threading member is fastened to the plastic middle member, a plurality of wire slots corresponded to the guide slots of the plastic middle member is furnished on the two facial surfaces of the plastic wire-threading member to accommodate the core wires therein.

In certain embodiments of the present invention, alternatively, a plurality of wire-threading holes corresponded to the guide slots of the plastic middle member can be furnished on the plastic wire-threading member.

In certain embodiments of the present invention, a plastic wire-guiding member is also fastened to said plastic wire-threading member, a plurality of wire slots to accommodate the core wires therein is furnished on the two facial surfaces of the plastic wire-guiding member, a supporting part is also formed at the rear portion of the plastic wire-guiding member.

In certain embodiments of the present invention, the opening of said wire slot is in the shape of an open pot mouth having a narrow middle portion and a wide lower portion.

In certain embodiments of the present invention, a plurality of latch slots is furnished on the two facial surfaces of the said metallic front shell, a plurality of latch lugs to engage with the latch slots of the metallic front shell is furnished on the two facial surfaces of the plastic front member; a protrusion to lock the metallic middle shell is further furnished on the top surface of the metallic front shell. The metallic middle shell is inserted jointed to the metallic front shell.

In certain embodiments of the present invention, a plurality of positioning poles is furnished at the end of said plastic middle member, a plurality of positioning holes to engage with the positioning poles of the plastic middle member is furnished at the end of the plastic wire-threading member.

The assembly process of the high definition digital interface in accordance with the present invention is to peel away firstly the outermost sheath of the core wire, and then to strip away the dense netted wire, the outer and inner aluminum foils orderly, wherein said process further comprises the steps of: (a) embedding the core wires into the corresponding wire slots of the plastic wire-guiding member; (b) embedding the core wires into the corresponding wire slots of the plastic wire-threading member by which the core wires are fixed; (c) removing the sheath of the core wires on the plastic wire-threading member and trimming the core wires; (d) brushing tin paste to the naked ends of the core wires; (e) assembling the plastic members to form a digital interface, and holding the core wires by means of a C-shaped hold clip to the corresponding terminal wiring ends; (f) inserting the head of the digital interface into the fixture installed on the feed belt of the automatic welder, the digital interface and the wires move with the movement of the feed belt; (g) moving the digital interface and the wires into the welding region of the automatic welder, the heating light stream will then emit out from the narrow gap of the automatic welder to heat the terminal wiring ends of the digital interface and the core copper wires with a heating time of 60s to 80s and a heating temperature of 150° C. to 220° C. The tin paste will be melted and thus the core wires and the terminal wiring ends are welded together at one time. The welding process will be completed after the wires are moved out of the automatic welder with the feed belt; (h) taking out the digital interface from the fixture of the automatic welder and removing away the C-shaped hold clip; and (i) obtaining the finished products.

In the high definition digital interface of the present invention, the plastic middle member is used for accommodating the core wires and the terminal wiring ends, the plastic wire-guiding and wire-threading members are used for guiding and fixing the core wires so as to prevent the core wires from free swinging and to facilitate the various mechanical processes. For example, the sheath of all core wires can be removed by only processing at most two times, since the sheath of core wires at one surface of the plastic wire-threading member can be stripped away at one time. Furthermore, since the core wires are arranged orderly in correspondence with the terminal wiring ends to be welded thereon, the automatic welding process can also be realized easily, and the interference of high frequency signals transmitted in the core wires can be avoided. In addition, the supporting part at the rear portion of the plastic wire-guiding member also serves to guide and centralize the core wires.

Differentiated from the steps of current assembly process, the assembly process of a high definition digital interface of the present invention emphasizes on the automatic welding process. Since the core wires are held and arranged by means of the plastic wire-threading member, the ends of the core wires can be conveniently trimmed up simultaneously; the core wires are then brushed with tin paste and are fixed by C-shaped hold clip into the corresponding terminal wiring ends, and are then sent to the welding region of the automatic welder for welding. The ends of all core wires can be welded at one time, so it is time efficient and labor saving. Besides, the consistency of the size of the welding spot are improved, the welding spots do not contact to each other so that the short circuit therebetween is avoided.

As a result, the high definition digital interface of the present invention not only has a simple structure, but also offers the advantages of free interference of high frequency signals between the core wires, stable high frequency characteristic, and improved anti-disturbance capability. The assembly process of the present invention not only is simple, but also has the features of automatic welding process, improved welding quality, higher work efficiency, lower percentage of bad products, and saved manpower and material.

DETAILED DESCRIPTION OF THE INVENTION

Figure 1:
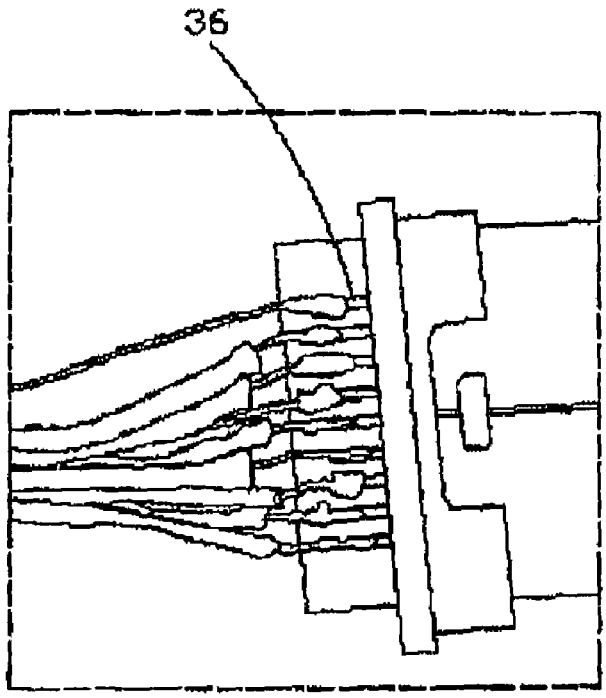
FIG. 1 PRIOR ART
FIG. 1 is a structural view of an existing digital interface and of welded core wires by means of the current welding process.

The configuration of a steering wheel according to the embodiments of the present invention is explained hereinafter referring to the drawings.

Figure 2:
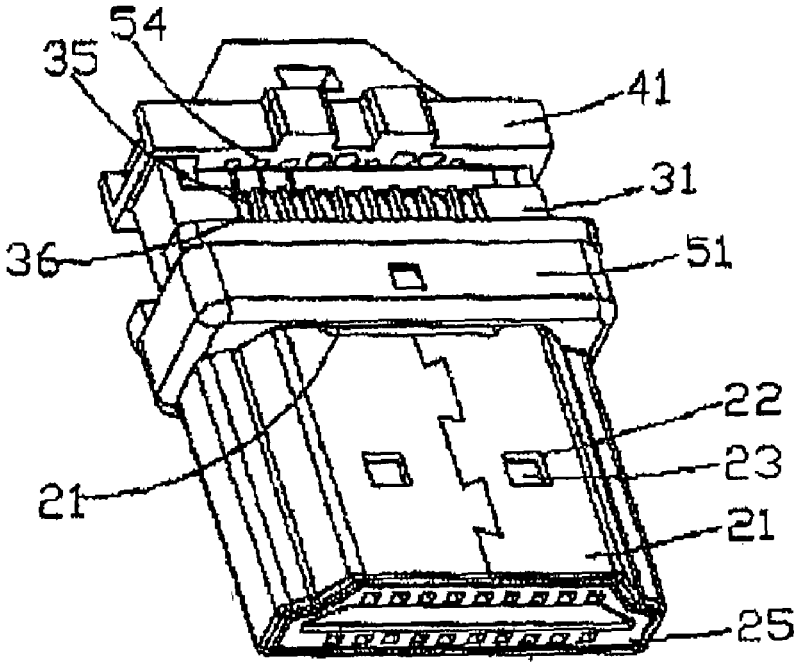
FIG. 2 is a structural view of a high definition digital interface in accordance with a first embodiment of the present invention.
Figure 3:
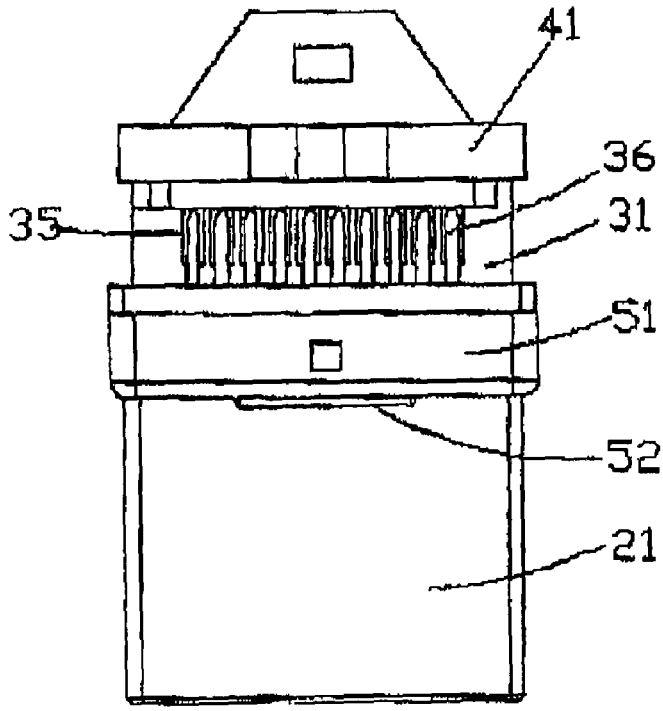
FIG. 3 is a front view of FIG. 2 of the present invention.

FIGS. 2-3 illustrates a high definition digital interface in accordance with a first embodiment of the present invention, including: a terminal; a metallic front shell 21; a plastic front member 25; a plastic middle member 31; and a plastic wire-threading member 41, wherein a plurality of latch slots 22 is furnished on the two facial surfaces of said metallic front shell 21, a plurality of latch lugs 23 to engage with the latch slots 22 is furnished on the two facial surfaces of the plastic front member 25, the plastic front member 25 is inserted inside the metallic front shell 21 and is fixed by the engagement of the latch slots 22 and the latch lugs 23. Namely, the plastic front member 25 is fixed inside the metallic front shell 21, the terminal is inserted into the plastic front member 25, the terminal wiring ends 36 is located at the rear portion of the terminal and serves to connect with the core wires, and is embedded inside the guide slots 35 of the plastic middle member 31.

In the present embodiment, a metallic middle shell 51 is inserted jointed with said metallic front shell 21 and is locked by means of protrusions 52 furnished on the metallic front shell 21. The metallic middle shell 51 serves to enclose the plastic middle member 31 to protect it from being damaged or scratched.

A plurality of guide slots 35 is furnished on the two facial surfaces of said plastic middle member 31, the number and the position of the guide slots 35 are in correspondence with the terminal wiring ends of the digital interface. The plastic middle member 31 is fastened to the plastic front member 25 by means of the fasteners at the both sides of the plastic middle member 31. The guide slots at the two facial surfaces of the plastic middle member 31 serve to accommodate the terminal wiring ends 36 and the core wires. It is obvious that the terminal wiring ends 36 can be molded and formed with the plastic middle member 31 together. After the molding process, the terminal wiring ends 36 are housed inside the guide slots 35 of the plastic middle member 31, the upper surfaces of the terminal wiring ends 36 are exposed out of the plastics so that the core wires can easily be welded thereon.

A pair of positioning poles are also furnished at the end of said plastic middle member 31, a pair of positioning holes to engage with the positioning poles are furnished at the end of the plastic wire-threading member 41. By the engagement of the positioning poles with the positioning holes, the plastic wire-threading member 41 can be assembled easily with little assembly error.

Said plastic wire-threading member 41 is fastened to the plastic middle member 31 by means of fasteners. A plurality of wire-threading holes 54 corresponding to the guide slots 35 of the plastic middle member 31 is furnished on the plastic wire-threading member 41, and serves for the passage and fixation of the core wires so as to prevent the core wires from free swinging, to facilitate the mechanical processes, and to realize the automatic welding process.

Figure 4:
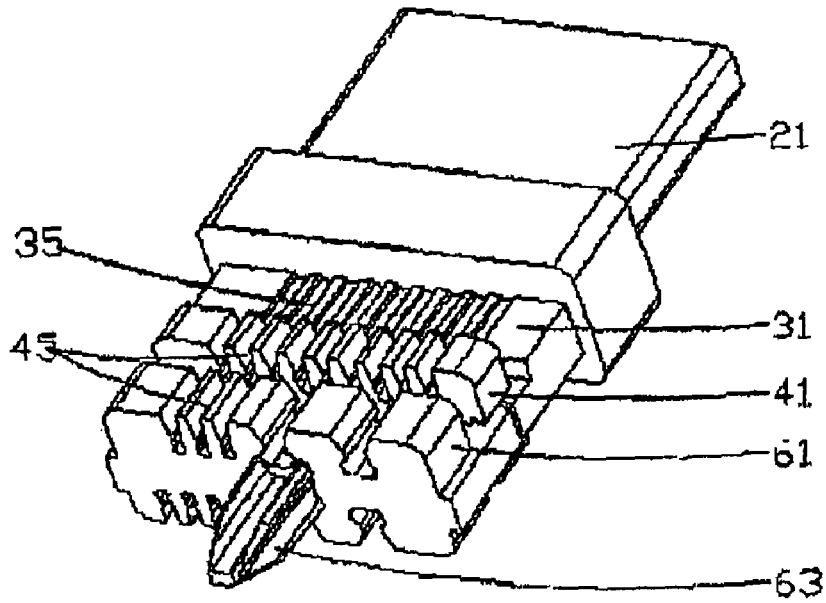
FIG. 4 is a structural view of a high definition digital interface in accordance with a second embodiment of the present invention.
Figure 5:
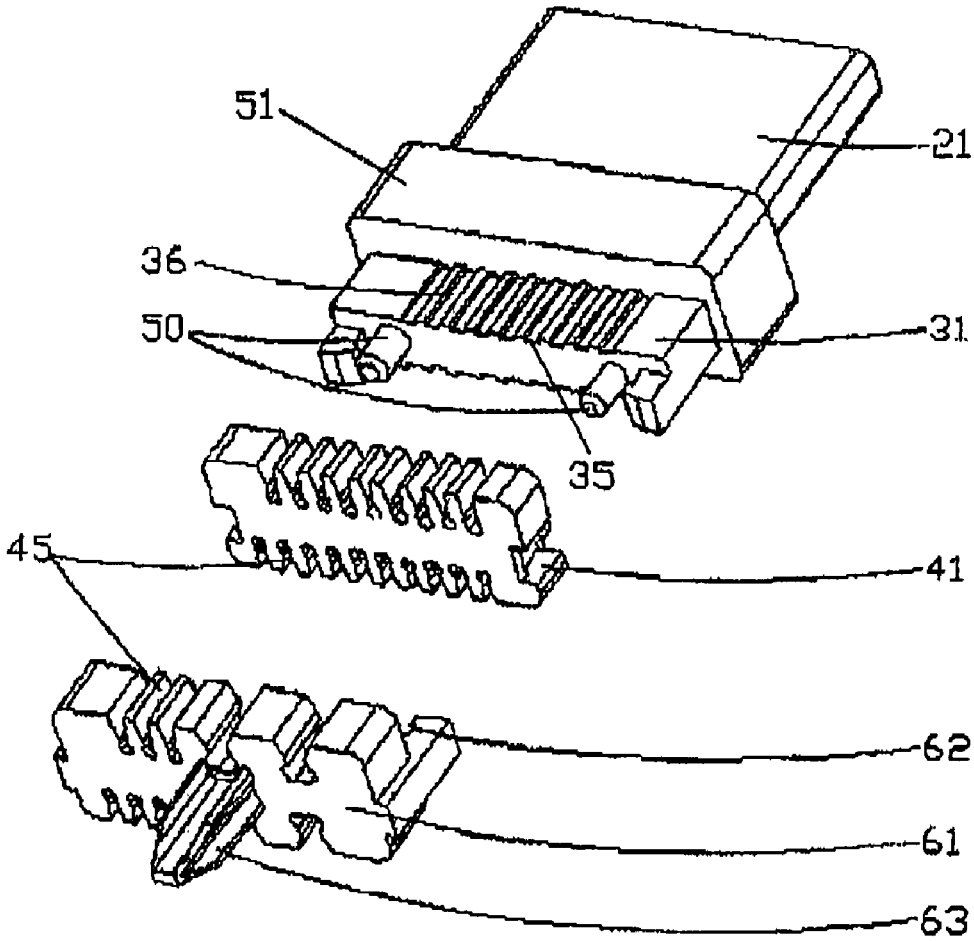
FIG. 5 is an exploded view of a high definition digital interface in accordance with a second embodiment of the present invention.

FIGS. 4-5 illustrates a high definition digital interface in accordance with a second embodiment of the present invention, comprising: a terminal wiring ends 36; a metallic front shell 21; a plastic front member 25; a plastic middle member 31; a plastic wire-threading member 41; and a plastic wire-guiding member 61, wherein said plastic front member 25 is inserted inside the metallic front shell 21, a plurality of guide slots 35 is furnished on the two facial surfaces of the plastic middle member 31, the number and the position of the guide slots 35 are in correspondence with the terminal wiring ends 36 of the digital interface; the plastic middle member 31 is fastened to the plastic front member 25 by means of fasteners at both sides of the plastic middle member 31, the guide slots 35 at the two facial surfaces of the plastic middle member 31 serves to accommodate the terminal wiring ends 36 and the core wires.

In the present embodiment, a plurality of wire slots 45 corresponding to the guide slots 35 of the plastic middle member 31 is furnished on the two facial surfaces of said plastic wire-threading member 41 which is fastened to the plastic middle member 31 by means of fasteners. A pair of positioning poles in different dimensions is also furnished on said plastic middle member 31, a pair of positioning holes to engage with the positioning poles is furnished on the plastic wire-threading member 41. By means of the engagement of the positioning poles 51 and the positioning holes 50, the plastic wire-threading member 41 can be assembled more easily with little assembly error, and can be matched with the plastic middle member 31 more accurately so as to avoid the displacement between the wire slots 45 and the guide slots 35. The core wires are embedded into the wire slots 45 through the openings of the wire slots, it is convenient and time saving, and the work efficiency is also increased. Since the openings of the wire slots 45 are in the shape of open pot mouth having a narrow middle portion and a wide lower portion, the core wires can be embedded into the wire slots 45 easily. In this way, not only the core wires can be prevented from free swinging, but also the mechanical processing and the automatic welding process can be realized easily.

In addition, a plastic wire-guiding member 61 is also fastened to said plastic wire-threading member 41, a plurality of clip jaws 62 served to connect the plastic wire-guiding member 61 to the plastic wire-threading member 41 is furnished on the plastic wire-guiding member 61. A plurality of wire slots 45 to accommodate the core wires is furnished on the two facial surfaces of the plastic wire-guiding member 61. A X-shaped supporting part 63 to support and separate the core wires is also furnished at the rear portion of the plastic wire-guiding member 61, and has a pointed end to facilitate the insertion of the core wires.

The assembly process of the high definition digital interface in accordance with the present invention is to peel away firstly the outermost sheath of the core wire, and then to strip away the dense netted wire, and the outer and inner aluminum foils, wherein said process further comprises the steps of:

(a) embedding the core wires into the corresponding wire slots of the plastic wire-guiding member 61;

(b) embedding the core wires into the corresponding wire slots 45 of the plastic wire-threading member 41 by which the core wires are fixed and prevented from free swinging and loosing;

(c) stripping away the sheath of the core wires by means of stripping machine. Since the core wires on the plastic wire-threading member 41 are arranged orderly in two rows, it is very convenient to strip away the sheath of the core wires in one row at one time by the stripping machine, thus it needs at most two times to strip away the sheath of all core wires. The core wires are then trimmed to right dimensions in accordance with the process requirements. Optionally, the sheath of the core wires in two rows can also be stripped away at one time.

(d) brushing resin firstly and then tin paste to the naked wire ends of the core wires by means of dipping the ends of the core wires into the tin paste and then dropping out. The weight of the tin paste on each end of the core wires is from 0.01 g to 0.1 g with an optimum value of 0.05 g. The control on the weight of the tin paste is to avoid the oversize or undersize of the welding spot in order to avoid the short circuit in the process of welding due to the inter-contact of the welding spots.

(e) assembling the plastic members to form a digital interface. After the plastic wire-threading member 41 is assembled with the plastic middle member 31, the core wires are just located into the guide slots 35 of the plastic middle member 31, and are then held by means of C-shaped holding clip so as to fix the ends of the core wires to their corresponding positions on the terminal wire ends 36 and thereby to facilitate the welding process.

(f) inserting the head (the metallic front shell 21) of the digital interface into the fixture installed on the feed belt of the automatic welder. The fixture is in the shape of hollow rectangular parallelepiped and has an open front end, the width and length of the hollow portion of the fixture are correspondent to those of the head of the digital interface, therefore, the head of the digital interface can be inserted into the fixture and fixed by the fixture easily. The digital interface and the wires will move with the movement of the feed belt of the automatic welder.

(g) moving the digital interface and the wires into the welding region of the automatic welder, the heating light stream, optionally the infrared light or other heating light, inside the automatic welder then emits out from a corresponding narrow gap on the automatic welder to heat the terminal wiring ends 36 and the core copper wires, the tin paste on the core wires is then melted to weld the core wires and the terminal wiring ends 36 together. The welding of all core wires can be carried out at one time with a heating time of 60s to 80s, optimally 70s; and a heating temperature of 150° C. to 220° C., optimally 160° C. The welding process is completed after the wires are moved out from the automatic welder with the feed belt. Certainly, the hot air or other heating methods can also be applied to melt the tin paste. In the present invention, the infrared light is used so that the energy is saved further, the time is saved by two thirds, and the percentage of bad products is decreased largely.

(h) taking out the digital interface from the fixture of the automatic welder and removing away the C-shaped hold clip; and (i) obtaining the finished products.

Although the present invention has been described with reference to the preferred embodiments thereof, it is apparent to those skilled in the art that there are a variety of modifications and changes that may be made without departing from the scope of the present invention which is intended to be defined by the appended claims.

What is claimed is:

1. A high definition digital interface, comprising:

a terminal;

a metallic front shell (21);

a plastic front member (25);

a plastic middle member (31) having two facial surfaces;

a plastic wire-threading member (41);

a plurality of guide slots (35);

a plurality of wire slots (45); and terminal wiring ends (36);

wherein said plastic middle member (31) is fastened to said plastic front member (25);

said plastic front member (25) being fixed inside said metallic front shell (21);

said guide slots (35) are furnished on said facial surfaces of the plastic middle member (31);

said plastic wire-threading member (41) is fastened to said plastic middle member (31);

said wire slots (45) corresponding to said guide slots (35) of the plastic middle member are disposed on facial surfaces of said plastic wire-threading member (41); and said terminal wiring ends (36) of the terminal are embedded into said guide slots (35) of said plastic middle member (31), wherein a plastic wire guiding member (61) is further attached to said plastic wire threading member (41), a plurality of wire slots (45) to accommodate the core wires are disposed on said facial surfaces of said plastic wire guiding member (61) and supporting part is further disposed at the rear portion of the plastic wire guiding member (61).

2. The interface of claim 1, wherein a plurality of wire-threading holes (54) corresponding to said guide slots (35) are disposed on said plastic wire-threading member (41).

3. The interface of claim 1, wherein an opening of said wire slot (45) is in the shape of an open pot mouth having a narrower middle portion and a wider lower portion.

4. The interface of claim 1, wherein a plurality of latch slots (22) is disposed on said facial surfaces of the metallic front shell (21), a plurality of latch lugs (23) to engage with the latch slots (22) is disposed on said facial surfaces of the plastic front member (21), a protrusion (52) to lock the metallic middle shell (51) is further disposed on said metallic front shell (21), and the metallic middle shell (51) is jointedly inserted into the metallic front shell (21).

5. The interface of claim 1, wherein a plurality of positioning poles (50) is disposed at the end of said plastic middle member (31), and a plurality of positioning holes to engage with the positioning poles (SD) is disposed on the plastic wire-threading member (41).

6. A process for assembling a high definition digital interface of claim 1 comprising the steps of:

(a) peeling away the outermost insulation of a wire comprising core wires an outermost insulation, a densely-netted wire and an outer and an inner aluminum foils;

(b) stripping away the densely-netted wire and the outer and inner aluminum foils;

(c) embedding the core wires into the corresponding wire slots (45) of the plastic wire-guiding member (61);

(d) embedding the core wires into the corresponding wire slots (45) of the plastic wire-threading member (41) by which the core wires are fixed;

(e) removing the sheath of the core wires on the plastic wire-threading member (41) and trimming the core wires;

(f) brushing tin paste onto the naked ends of the core wires;

(g) assembling the plastic members to form a digital interface, and holding the core wires by means of a C-shaped hold clip to the corresponding terminal wiring ends (36);

(h) inserting the head of the digital interface into the fixture installed on the feed belt of the automatic welder, the digital interface and the wires move with the movement of the feed belt;

(i) moving the digital interface and the wires into the welding region of the automatic welder, the heating light stream will then emit out from the narrow gap of the automatic welder to heat the terminal wiring ends (36) of the digital interface and the core copper wires with a heating time from 60 s to 80 s and a heating temperature from 1500° C. to 2200° C.; and (j) taking out the digital interface from the fixture of the automatic welder and removing away the C-shaped hold clip.

* * * * *